United States Patent [19]

Podiak

[11] Patent Number: 4,695,759

[45] Date of Patent: Sep. 22, 1987

[54] METHOD FOR PRODUCING A COMPOSITE CENTER ELECTRODE AND AN ELECTRODE

[75] Inventor: Richard S. Podiak, Maumee, Ohio

[73] Assignee: Champion Spark Plug Company, Toledo, Ohio

[21] Appl. No.: 316,206

[22] Filed: Oct. 29, 1981

[51] Int. Cl.[4] ..... H01T 13/20

[52] U.S. Cl. ..... 313/136; 313/141

[58] Field of Search ..... 313/136, 141; 29/25.14, 29/25.17

[56] References Cited

U.S. PATENT DOCUMENTS

| | | | |
|---|---|---|---|
| 2,849,788 | 9/1958 | Creek | 29/156.8 |
| 2,945,293 | 7/1960 | Last | 29/422 |
| 2,955,222 | 10/1960 | Beesch | 313/141 |
| 3,040,417 | 6/1962 | Newton | 29/156.7 |
| 3,144,576 | 8/1964 | Hagmaier et al. | 313/141 |
| 3,548,472 | 12/1970 | Urushiwara et al. | 29/25.12 |
| 3,818,555 | 6/1974 | Yamaguchi et al. | 29/25.12 |
| 3,857,145 | 12/1974 | Yamaguchi et al. | 29/25.12 |

*Primary Examiner*—Robert E. Wise

*Attorney, Agent, or Firm*—Oliver E. Todd, Jr.

[57] ABSTRACT

An improved method is disclosed for forming a composite spark plug electrode having a thermally conductive metal core embedded within a corrosion-resistant metal sheath. Initially, a composite billet is formed by positioning a mass of the thermally conductive metal within a cup formed from the corrosion-resistant metal having a closed end and an open end. The corrosion-resistant metal at the open end of the cup extends further than the thermal conducting metal. The composite billet is passed open end first through an extrusion orifice. A head may be formed on the end of the resulting extrusion for welding to a wire terminal or an end of a wire terminal is positioned within the open cup end prior to passing the cup through the extrusion orifice for mechanically bonding the extrusion to the terminal. Excess metal on the end of the cup may be removed from the resulting composite electrode or it may be sheared from the electrode and repositioned axially along the electrode to form a shoulder.

9 Claims, 12 Drawing Figures

METHOD FOR PRODUCING A COMPOSITE CENTER ELECTRODE AND AN ELECTRODE

BACKGROUND OF THE INVENTION

This invention relates to spark plug electrodes and more particularly to an improved method for producing a composite center electrode for a spark plug and to a center electrode produced by the method.

The prior art teaches various methods for producing composite center electrodes having an outer shell formed from a corrosion-resistant metal, such as a nickel alloy, and a core formed from a metal having a high thermal conductivity, such as copper. By providing a thermally conductive core to the center electrode, the firing tip of the spark plug operates at a lower temperature. The lower electrode temperature allows the spark plug to be operated at higher specific outputs without causing preignition.

One prior art method for forming a spark plug center electrode having a high thermally conductive core involves first forming a cup from a corrosion-resistant metal. The cup has a closed end and a tubular wall extending upwardly from the closed end to an open end to define a cavity extending centrally therein. A composite billet then is formed by positioning interiorly of the cup a close-fitting right circular cylindrical billet of a metal having a high thermal conductivity. The billet fits tightly within the cup walls to form the composite billet. The method further involves inserting the closed end of the composite billet into the upper end of a bore in an extrusion die. The billet is moved through the bore until it contacts an extrusion orifice of reduced diameter relative to the upper bore and pressure is applied through a plunger to force all except a terminal portion of the billet through the extrusion orifice to form an electrode blank. The electrode blank has the unextruded terminal portion as an upper headed portion, a lower portion of reduced diameter extending longitudinally therefrom and a copper or other thermally conductive metal core extending longitudinally therein. After the electrode blank is removed from the die, it is suitable for use as a composite center electrode in a spark plug. Such a process is illustrated, for example, in the U.S. Pat. No. 3,857,145.

In a modified prior art method for making a composite center electrode, a cup formed from a corrosion-resistant metal is partially filled with a high thermally conducting metal, such as copper, to form a composite billet. The copper is in contact with a closed end of the cup and is spaced inwardly from an open end of the cup. After the composite billet is formed, the edges on the open end of the cup may be turned slightly inwardly to retain the copper within the cup. The composite billet then is inserted into the bore of an extrusion die, closed end first, and pressure is applied through a plunger to force all except a terminal portion of the billet through an extrusion orifice. During the extrusion process, the corrosion-resistant metal at the previously opened end is closed over the thermally conductive core to form a terminal end on the electrode blank. After the electrode blank is removed from the die, the terminal end is further shaped on a header machine and is trimmed, as necessary, to form a terminal having a desired shape. Since the terminal end is formed completely from nickel alloy or some other corrosion-resistant material used for forming the outer surfaces of the electrode blank, a metal terminal wire is easily welded to the terminal end to complete manufacture of the electrode blank.

Both of the above-described methods for forming a composite center electrode for spark plugs initially pass the closed end of the composite billet first through an extrusion orifice. In both cases, the firing end of the center electrode can have a relatively large mass of the corrosion-resistant metal. Above this relatively large mass, the copper or thermally conductive core begins first at a relatively small diameter and increases to a larger diameter in a direction moving along the length of the electrode. Consequently, there is a relatively long heat transfer path from the lower end of the center electrode to the point at which the heat conducting core has a large diameter. Another problem ocurring in these prior art methods is in excessive wear on the plunger or tool used for forcing the composite blank through the extrusion orifice. The tool typically is shaped to form a welding nib on the end of the electrode for use in attaching a terminal wire. The shaped tool has a limited life and, consequently, the machine extruding the composite electrode must be shut down frequently for maintenance to replace the tool.

SUMMARY OF THE INVENTION

The present invention is directed to an improved method for producing thermally conducting composite center electrodes for spark plugs. According to one embodiment of the invention, a cup having generally tubular sides, a closed end and an open end is formed from a nickel alloy or some other suitable corrosion-resistant metal. A billet of copper, or some other metal having a high thermal conductivity, is positioned within the cup to contact the closed end and the sides and to stop a short distance inwardly from the open end of the cup. The copper billet is upset in the cup to retain it in place and, preferably, edges at the open end of the cup are crimped inwardly to more positively retain the copper billet within the cup. The resulting composite billet then is inserted, open end first, into a close fitting bore of an extrusion die having a reduced diameter extrusion orifice. A flat ended plunger or punch is advanced to force substantially all of the composite billet through the extrusion orifice, leaving only the extrusion butt at the solid nickel alloy end of the electrode remaining above the extrusion orifice. The resulting electrode blank is removed from the extrusion die and excess metal in the butt is sheared off longitudinally to the electrode shaft to provide a squared solid nickel alloy end suitable for forming a spark gap without additional treatment. The originally opened nickel alloy end of the electrode blank which was closed during extrusion, may be shaped on a header to form an enlarged diameter head with a protruding nib for welding to a terminal wire to complete the composite electrode.

In a modified embodiment of the invention, after the composite billet is formed by upsetting a copper billet within a nickel alloy cup so that the copper is forced inwardly from the open end of the cup, an iron terminal wire having a diameter slightly smaller than the extrusion orifice is positioned with an end extending into the open cup end to abut the end of the copper billet. This assembly is passed through an extrusion orifice, with the terminal wire passing through the orifice first. The extrusion force is applied through a flat ended plunger or tool which presses against the closed end of the composite billet. During the extrusion process, sufficient spring force is applied to the terminal wire to maintain the wire end in contact with the copper billet within the cup. As the composite billet is forced through the extrusion orifice, the nickel alloy walls of the cup which extend over the end of the terminal wire are forced inwardly against and deform the wire to provide a locking grip between the nickel alloy and the terminal wire. This grip provides sufficient electrical and mechanical contact to eliminate the need for welding between the wire and the nickel alloy. The punch continues to push substantially all of the composite billet through the extrusion orifice, except for an extrusion butt remaining at the originally closed end of the cup. The electrode is removed from the extrusion die and excess metal on the butt end of the electrode is removed by longitudinally shearing. If desired, only a portion of the excess metal is removed and, at the same time, the remaining metal is shaped to form an annular shoulder. This annular shoulder is longitudinally sheared from the end of the electrode to leave a squared spark gap end. The sheared shoulder is positioned on the electrode a predetermined distance from the end of the electrode which forms the spark gap.

Accordingly, it is a preferred object of the invention to provide an improved method for forming thermally conducting composite center electrodes for spark plugs.

Other objects and advantages of the invention will become apparent from the following detailed description, with reference being made to the accompanying drawings.

BRIEF DISCRIPTION OF THE DRAWINGS

Figure 11:
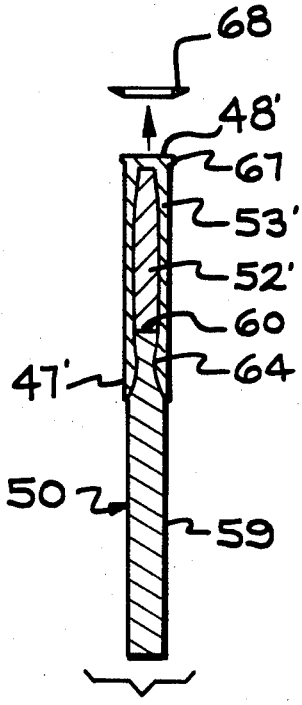
Figure 12:
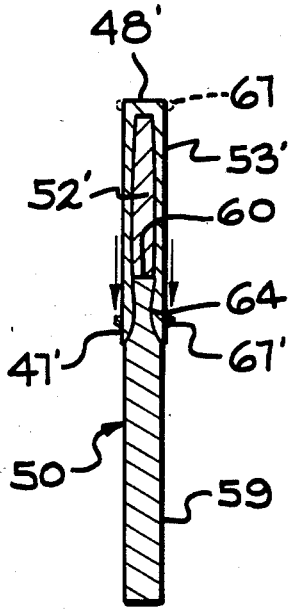

FIG. 11 is a cross sectional view showing the shearing of a portion of the excess metal from the butt end of the composite electrode and showing the remaining shoulder on the end of the composite electrode; and FIG. 12 is a cross sectional view showing the longitudinal shearing of the shoulder from the composite electrode and repositioning of the shoulder axially along the composite electrode of complete the composite electrode.

DESCRIPTION OF THE PREFERRED EMBODIMENTS

Figure 1:
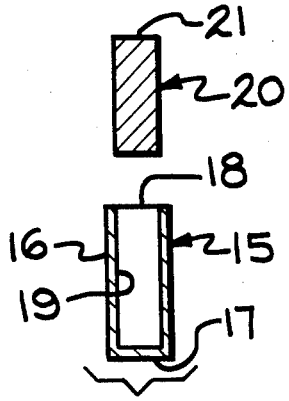
FIG. 1 is a vertical cross sectional view showing a corrosion-resistant metal cup and cylindrical billet of metal of a high thermal conductivity prior to being inserted into the cup in accordance with a first step of the method of the present invention.
Figure 2:
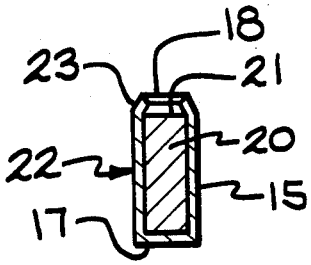
FIG. 2 is a cross sectional view showing a composite billet after the thermally conductive billet is inserted into the corrosion-resistant cup, upset or staked in place and the edges of the cup are crimped inwardly to retain the copper billet in place.
Figure 3:
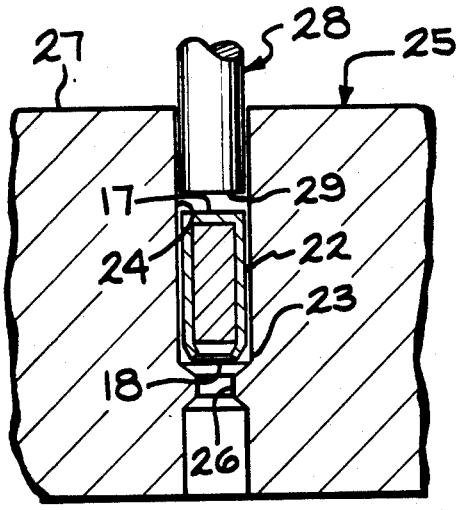
FIG. 3 is a fragmentary cross sectional view showing the composite billet positioned within the bore of an extrusion die prior to extrusion.

Referring now to the drawings and particularly to FIG. 1, a cup 15 is illustrated formed from a corrosion-resistant material, such as nickel alloy. The cup 15 is formed to have a generally tubular side wall 16, a closed end 17 and an open end 18. The side 16 and the end 17 of the cup 15 define a right circular cylindrical opening 19. A billet 20 of a metal having a high thermal conductivity, such as copper, is positioned within the cup opening 19. The billet 20 is shaped slightly smaller than and generally to conform with the interior surfaces of the cup end 17 and the tubular side 16. However, the billet 20 is formed to have a longitudinal dimension shorter than the longitudinal dimension of the cup opening 19 so that an upper end 21 on the billet 20 will be spaced interiorly of the open cup end 18 when the billet 20 is positioned within the opening 19. Preferrably, pressure is applied to the billet end 21 after the billet 20 is inserted into the cup opening 19 to expand the billet 20 into contact with the cup side wall 16 and thereby retain it within the cup 15. The cup 15 and the billet 20 form a composite billet 22, as shown in FIG. 2. Optionally, a crimp 23 is formed in the portion of the cup side 16 above the billet end 21 and adjacent the opening 18. The crimp 23 slightly reduces the diameter of the opening 18 to more positively retain the copper billet 20 within the cup 15.

After the composite billet 22 is completely formed, it is inserted, open end 18 first, into the upper end of a close fitting bore 24 of an extrusion die 25. The bore 24 has a diameter just slightly larger than the exterior diameter of the billet 22 so as to allow the billet 22 to slide axially within the bore 24 without tipping. A reduced diameter extrusion orifice 26 is located within the bore 24 and spaced from an upper surface 27 of the die 25 by distance greater than the length of the composite billet 22. After the composite billet 22 is inserted within the bore 24, a tool or extrusion punch 28 having a flat end 29 is inserted into the bore 24 until the end 29 abuts the flat closed end 17 on the composite billet 22. The flat end 29 on the extrusion punch 28 also has a diameter only slightly smaller than the diameter of the bore 24 so that the punch can be advanced in the bore 24 and pressure is applied by the punch end 29 across the entire closed end 17 of the billet 22.

Figure 4:
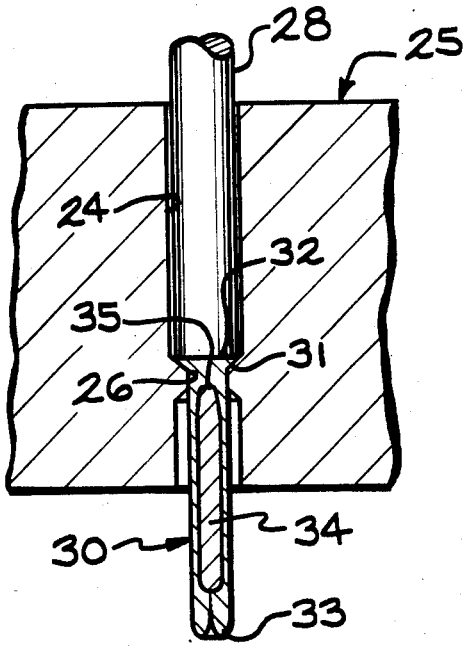
FIG. 4 is a fragmentary cross sectional view, similar to FIG. 3, but showing the billet within the extrusion die at completion of extrusion.

The punch 28 is advanced in the extrusion die bore 24 to force the composite billet 22 through the extrusion orifice 26, as shown in FIG. 4. As the composite billet 22 is forced through the extrusion orifice 26, an extrude electrode blank 30 is formed. Since the punch 28 has a diameter greater than that of the extrusion orifice 26, the entire composite billet 22 cannot be forced through the orifice 26, leaving an annular butt 31 having an enlarged diameter extending from a closed end 32 on the electrode blank 30. The extrusion punch 28 then is retracted from the die bore 24 and the electrode blank 30 is pushed by suitable plunger (not shown) back through the orifices 26 and is withdrawn from the bore 24.

During the extrusion process, the corrosion-resistent metal in the crimped end 23 of the cup portion of the composite billet 22 is forced together at an end 33 of the electrode blank 30 to entirely enclose a core 34 which was formed from the copper billet 20. It will be noted that the core 34 has an end 35 adjacent to closed end 32 of the electrode blank 30 which is substantially flat. This configuration provides for better heat flow from the electrode end 32 than that achieved in prior art electrodes wherein the composite blank closed end was first passed through the extruder orifice. By passing the open end 18 of the composite blank through the extruder orifice first the location of the core end 35 is more easily controlled than in prior art methods. Both the stop point of the forward extrusion and the electrode head end 32 are fixed relative to the solid closed end 17 of the electrode blank 22.

Figure 5:
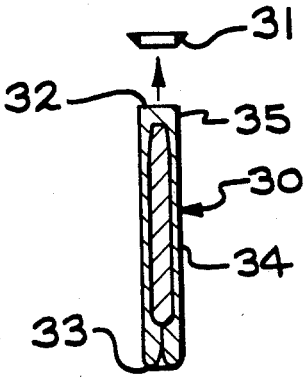
FIG. 5 is a cross sectional view through electrode blank after extrusion and after excess metal is sheared from the butt at the non-extruded end of the electrode blank.
Figure 6:
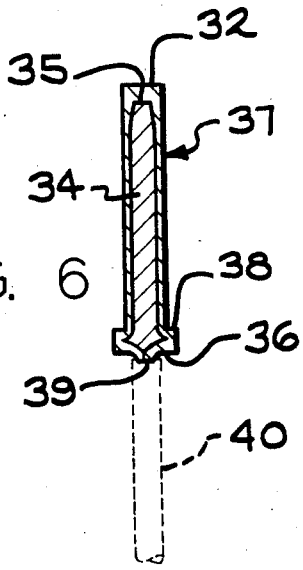
FIG. 6 is a cross sectional view through a completed composite electrode after a terminal portion is formed on the end of the electrode which was formed from the initially open end of the composite billet.

After the electrode 30 is removed from the extrusion die 25, the enlarged diameter butt 31 is sheared from the electrode blank 30, as illustrated in FIG. 5. This results in the electrode blank 30 having a uniform diameter throughout its length and a flat end 32 extending perpendicular to the axis of the electrode blank 30 for forming one side of a spark gap in a spark plug. As illustrated in FIG. 6, a head 36 is formed on the end of the electrode blank 30 to complete formation of a composite electrode 37. The head 36 is provided with an enlarged diameter to form a shoulder 38 for seating within a stepped bore in a spark plug insulator (not shown). The head 36 also defines a terminal portion or nib 39 to which an iron terminal 40 may be welded.

Figure 7:
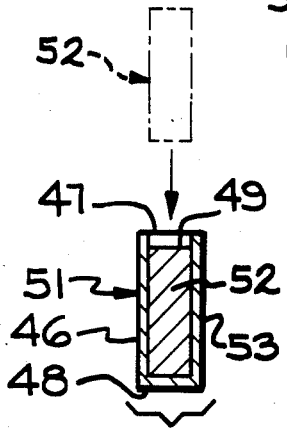
FIG. 7 is a cross sectional view, similar to FIG. 1, showing the initial step in forming a composite center electrode in accordance with a modified embodiment of the invention.

FIGS. 7–12 illustrate a modified method for producing a composite spark plug electrode 50. FIG. 7 is similar to FIG. 1 and shows the forming of a composite billet 51 by inserting a copper billet 52 into a nickel alloy cup 53 having a tubular side wall 46, an open end 47 and a closed end 48. The copper billet 52 then is pressed into the cup 53 by applying pressure to a billet end 49 to expand the billet 52 into contact with the interior walls of the cup 53. Consequently, the copper billet 52 is retained within cup 53, even though the composite billet 51 may be inverted. The expanded billet 52 does not completely fill the cup 51 so that the billet end 49 is spaced interiorly of the cup end 47.

Figure 8:
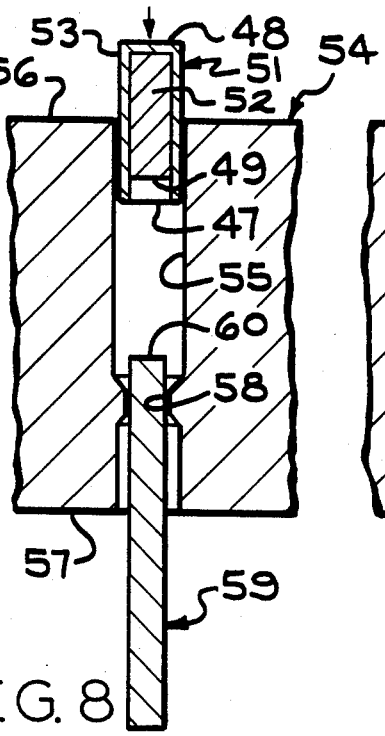
FIG. 8 is a fragmentary cross sectional view showing an iron rod positioned in the lower end of an extrusion die bore and showing the composite billet being inserted open end first into the upper end of the bore.

Turning to FIG. 8, a fragmentary portion of an extrusion die 54 is shown defining a bore 55 extending between an upper surface 56 and a lower surface 57. A reduced diameter extrusion orifice 58 is located within the bore 55 between the upper and lower surfaces 56 and 57. A terminal 59 is inserted into the bore 55 to extend downwardly through the orifice 58 so that an upper end 60 on the wire 59 is spaced a slight distance above the orifice 58. The terminal 59 may be of an inexpensive electrically conductive metal such as iron. Suitable apparatus (not shown) is provided for holding the terminal 59 centered within the orifice 58 and to provide a spring or resilient force against which the terminal 59 may move downwardly within the die bore 55 during extrusion. It should be noted that the terminal 59 must have a diameter slightly smaller than the diameter of the orifice 58. For example, if the orifice 58 is 0.100 inch diameter, then the terminal 59 may be on the order of 0.090 inch diameter. If the wire 59 has the same diameter as the orifice 58, the wire end 60 may be pinched off during extrusion.

Figure 9:
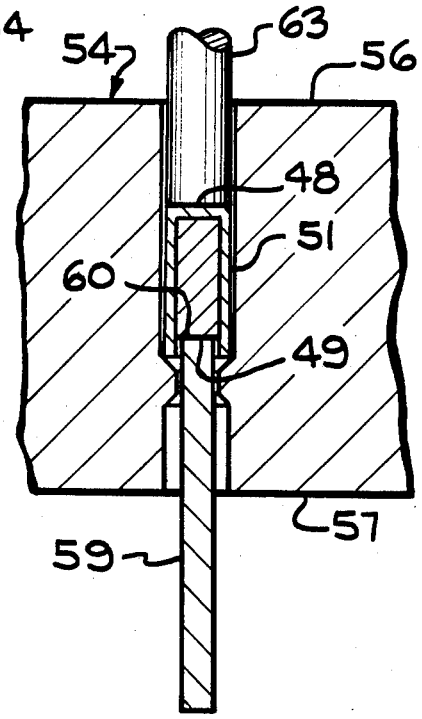
FIG. 9 is a fragmentary cross sectional view showing the composite billet and the terminal wire positioned together within the extrusion die bore prior to passing the composite billet through the extrusion orifice.

In addition to inserting the terminal 59 into the die bore 55, the composite billet 51 is inserted into the top of the bore, with the open end 47 entering the bore 55 first. When the copper billet 52 was inserted into the cup 53 in forming the composite billet 51, the copper did not entirely fill the cup 53. The exposed copper end 49 is recessed from the open cup end 47. This recess may be on the order of 0.100 inch–0.125 inch, for example. When the composite billet 51 is inserted open end first into the die bore 55, it moves downwardly in the die bore 55 until the terminal end 60 contacts the recessed copper billet end 49, as shown in FIG. 9. After the composite billet 51 is inserted into the die bore 55 and contacts the terminal end 60, a flat end 62 of an extrusion punch or tool 63 is inserted into the die bore 55 and is advanced downwardly into contact with the flat closed end 48 of the composite billet 51.

Figure 10:
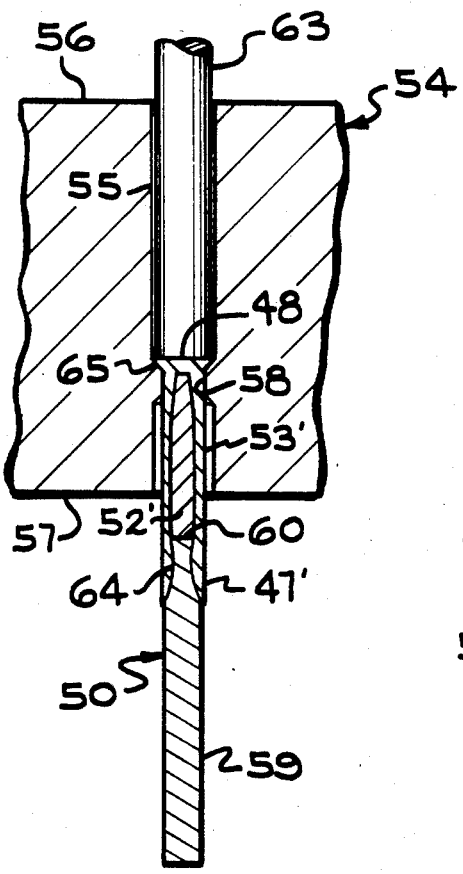
FIG. 10 is a fragmentary cross sectional view similar to FIG. 9, but showing the composite electrode within the extrusion die at completion of the extrusion.

As the extrusion punch 63 is further advanced, the composite billet 51 and the terminal end 60 are pushed downwardly through the extrusion orifice 58, as illustrated in FIG. 10. As the terminal end 60 and the surrounding portions of the open cup end 47 pass through the extrusion orifice 58, the nickel alloy at the open cup end 47 is forced inwardly to deform the terminal end 60 at 64. A mechanical bond is thus formed between the wire 49 and the extruded end 47' of the extruded nickel alloy cup 53'. The extrusion punch 63 is advanced nearly to the extrusion orifice 58, leaving above the orifice 58 only an enlarged diameter annular butt 65 extending radially from the closed end 48 of the extruded cup 53'. It will be seen that after extrusion, the extruded copper billet 52' completely fills the void between the extruded cup 53' and the end 60 of the terminal 59. However, it should be noted that a void may occur between the terminal wire end 60 and the extruded copper billet 52' without adversely affecting the operation of the composite electrode 50 since heat flow to the terminal 49 normally is not important. Consequently, the terminal end 60 may be held within the open billet end 47 without touching the copper billet end 49 during extrusion, if desired. Also, the tubular side wall 46 may be crimped inwardly to frictionally engage the terminal end 60 prior to extrusion.

After extrusion is completed, the extrusion punch 63 is withdrawn from the die bore 55 and the composite electrode 50 is pushed upwardly back through the extrusion orifice 58 in order to withdraw the composite electrode 50 from the die 54. If desired, the butt 65 may be removed from the composite electrode 50 by shearing in a manner similar to that used for removing the butt 31 from the electrode blank 30 shown in FIG. 5. Or, the butt 65 may be used for forming a shoulder 67 on a composite electrode 50, as illustrated in FIGS. 11 and 12. An outer portion 68 of the butt 65 having the largest diameter is removed from the electrode end 48', for example, by shearing. This leaves the shoulder 67 on the electrode end 48' as illustrated in FIG. 11. The shoulder 67 then is sheared from the electrode end 48' and is forced downwardly over the extruded cup 53' to a desired position leaving a shoulder 67' having a predetermined axial spacing from the electrode end 48'. The shoulder 67' remains at this location on the finished composite electrode 50 due to frictional forces exerted between the shoulder 67' and the extruded cup 53' portion of the electrode 50. It should be noted that the sheared shoulder 67' may be moved downwardly over the extruded nickel cup 53' or it may be sheared off of the electrode end 48' and subsequently reinserted over the terminal 59 and moved upwardly to a desired location on the extruded cup 53'.

It will be appreciated that various modifications and changes may be made in the above described preferred embodiments of the invention. For example, it should be noted that only exemplary materials have been described for use in forming the composite spark plug electrodes. The dimensional sizes provided in the above description are only exemplary and also are not intended to restrict the invention. The above described punches 28 and 63 have flat ends for applying force to the flat closed end of the composite billet during extrusion. The flat end tends to increase the life of the punch. However, it should be noted that the punch end may have any desired shape. For example, a break or chamfer may be formed at the outer edge of the punch end, if desired, without departing from the invention. Various other changes and modifications may be apparent to those skilled in the art without departing from the spirit and scope of the following claims.

What I claim is:

1. A method for producing a composite spark plug electrode comprising the steps of: forming from a corrosion resistant first metal a cup having a tubular side, an open end and a closed end; partially filling said cup with a second metal having a high thermal conductivity with said second metal contacting interior surfaces of at least said closed end and being spaced inwardly from said open end; inserting said partially filled cup open end first into a close-fitting bore of a die having within such bore an extrusion orifice of a diameter less than that of such bore; inserting a plunger into such bore and into contact with said closed end and applying pressure to said plunger to force substantially all of said partially filled cup except said closed end through said extrusion orifice to form an electrode blank whereby all of said second metal is extruded to a diameter smaller than said orifice diameter; removing said electrode blank from said die; and removing all excess first metal greater than said orifice diameter from the end of said electrode blank which did not pass through said extrusion orifice.

2. A method for producing a composite spark plug electrode, as set forth in claim 1, and further including the step of forming a terminal portion on the end of said electrode blank which was passed through said extrusion orifice, said terminal portion closing such electrode blank end with said first metal.

3. A method for producing a composite spark plug electrode, as set forth in claim 1, and further including the step forming a generally inwardly directed edge on said open end on said partially filled cup prior to inserting said partially filled cup into said die bore.

4. A method for producing a composite spark plug electrode, as set forth in claim 1, and further including the steps of inserting an end of a terminal wire having a diameter slightly smaller than the diameter of said extrusion orifice into the open end of said partially filled cup prior to forcing said partially filled cup through said extrusion orifice, and holding said terminal end in the open cup end while said open cup end and said terminal end are forced through said extrusion orifice whereby the extruded open cup end of said electrode blank is mechanically and electrically connected to said terminal wire end.

5. A method for producing a composite spark plug electrode, as set forth in claim 4, wherein said terminal end is held in contact with said second metal as the open cup end and said terminal end are forced through said extrusion orifice.

6. A method for producing a composite spark plug electrode, as set forth in claims 1, 3, 4, or 5 wherein only a portion of excess first metal is removed from the end of said electrode blank leaving an enlarged diameter portion on the end of said electrode blank, and further including the steps of shearing said enlarged diameter portion from said electrode blank and positioning such sheared portion a predetermined distance along said electrode blank from the closed end of said electrode blank to form a shoulder on said electrode blank.

7. A composite electrode for a spark plug comprising a core formed from a high thermally conductive metal, a wire terminal formed from a metal different from said thermally conductive metal having a predetermined diameter and an end abutting said conductive metal, said terminal having a diameter at said end smaller than said predetermined diameter and having a constricted diameter smaller than said end diameter adjecent said end, and a sheath formed from a corrosion-resistant metal surrounding and in contact with said thermally conductive metal, said terminal end and said constricted diameter portion of said terminal whereby said thermally conductive metal is completely enclosed.

8. A composite electrode for a spark plug, as set forth in claim 7, and wherein said corrosion-resistant metal has a cylindrical outer surface having a diameter slightly greater than said predetermined diameter and has a generally flat end.

9. A composite electrode for a spark plug, as set forth in claims 7 or 8, and further including an annular shoulder frictionally engaging and projecting outwardly from said corrosion-resistant metal.

* * * * *